US005595380A

United States Patent [19]

McCue, Jr. et al.

[11] Patent Number: 5,595,380

[45] Date of Patent: Jan. 21, 1997

[54] SHEET MEDIA HANDLING SYSTEM FOR ALIGNED INSERTION OF SINGLE SHEET MEDIUM

[75] Inventors: Thomas E. McCue, Jr., Vancouver; Raymond C. Sherman; Shannon D. Casey, both of Camas; Steve O. Rasmussen, Vancouver; Sandra Y. Okazaki, Redmond, all of Wash.

[73] Assignee: Hewlett-Packard Company, Palo Alto, Calif.

[21] Appl. No.: 396,190

[22] Filed: Feb. 28, 1995

[51] Int. Cl.[6] ..... B65H 5/26

[52] U.S. Cl. ..... 271/9.09; 271/240; 271/171

[58] Field of Search ..... 271/9.09, 9.11, 271/240, 241, 171

[56] References Cited

U.S. PATENT DOCUMENTS

| | | | |
|---|---|---|---|
| 2,938,723 | 5/1960 | Paulson | 271/240 |
| 3,350,091 | 10/1967 | Masterson et al. | 271/240 |
| 4,181,078 | 1/1980 | Davis . | |
| 4,216,719 | 8/1980 | Flaceliere et al. . | |
| 4,772,007 | 9/1988 | Kashimura | 271/171 |
| 4,955,595 | 9/1990 | Kawano et al. | 271/9.09 |
| 5,091,754 | 2/1992 | Abe et al. | 271/240 |
| 5,222,722 | 6/1993 | Kamano | 271/171 |
| 5,261,651 | 11/1993 | Ishida | 271/9.09 |
| 5,478,162 | 12/1995 | Nakayama et al. | 271/9.09 |

*Primary Examiner*—Karen B. Merritt
*Assistant Examiner*—Douglas Hess

[57] ABSTRACT

A sheet media handling system is provided for use in a sheet processor (e.g., a printer). Such system incorporates an input tray for storing one or more sheet media prior to input through the printer's input port with the input tray vertically stacked with the printer's output support structure or tray. The system also has a single sheet medium guide mechanism adjacent the printer's output support structure, where the medium guide mechanism routes a single medium to the input port when the single medium is inserted therein. The single sheet medium guide mechanism includes a skew-abatement substructure and a deflection mechanism. The skew-abatement substructure is designed to facilitate alignment of and routing of a single medium towards the input port by contacting a first edge of the single medium and an opposite second edge of the single medium. Such a deflection mechanism is designed to deflect a single medium toward and into the input port by contacting the upper surface of the single medium while also contacting the lower surface of the single medium. The invented system facilitates easy manual insertion and alignment of a single medium (e.g., an envelope or postcard) into the input port of a printer without affecting the existing supply of sheet media in the input tray.

16 Claims, 6 Drawing Sheets

SHEET MEDIA HANDLING SYSTEM FOR ALIGNED INSERTION OF SINGLE SHEET MEDIUM

TECHNICAL FIELD

The present invention relates generally to sheet media handling, and more particularly, to a system for handling a single sheet medium without affecting the input supply of sheet media while ensuring proper alignment of the single sheet medium. Although the invention has broad utility, it has proven particularly well-suited for use in an ink-jet printer that typically holds a supply of sheet media and has an input path for narrow sheet media, such as an envelope or postcard.

BACKGROUND ART

In a conventional ink-jet printer, sheet media are directed through a print cycle which includes picking up a single medium from an input tray, feeding it to an input port and through a print zone for printing, and then expelling it through an output port. Such an ink-jet printer typically has a supply of sheet media in the input tray and an output support structure or tray for receiving paper expelled from the output port. The printer has a sheet-media drive mechanism for picking up or pulling in a single medium from the top of the input stack in the input tray. The drive mechanism includes drive rollers that contact the top sheet medium in the input tray and drive it through a print zone located generally inside the housing or chassis of the printer. After printing, the drive mechanism feeds the sheet media out the output port and onto an output tray (or other output support structure).

Generally, an ink-jet printer is capable of handling sheet media of various sizes, including standard letter size (8½"× 11"), legal size (8½"×14"), various other paper sizes and narrow sheet media such as envelopes, stationary and postcards. Ink-jet printers usually have only one input source or input tray to reduce the printer's footprint, complexity and cost.

Accordingly, if a user wishes to print on a single sheet medium (e.g., an envelope or a postcard) that is narrower than the type of media already in the input tray, then the user carefully places the narrow medium on top of or in place of the sheet media in the input tray. In most ink-jet printers, printing on narrow media is done on the far right extreme of the print zone of the printer. Thus, the user must ensure that the single medium is flush to the right side of the input tray and aligned so that it enters the input port nearly perfectly straight. When a narrow medium is inserted, drive rollers catch the narrow medium and pull it into the printer. This narrow medium insertion process is annoying at best and troublesome at worst. This process causes the user to disturb or affect the sheet media in the input tray by placing the narrow medium on top of the existing sheet media or in place of the existing sheet media. In addition, the user's alignment of the single medium is likely to produce skew or misalignment.

Conventionally, sheet media used in the printers, such as an ink-jet printer, have the shape of a right rectangle where each edge of a medium is one side of the right rectangle. The sheet media have two substantially planar surfaces on which various text and graphics can be printed. Generally, it is undesirous to have the text printed on the sheet medium to be misaligned, askewed, crooked, or oblique. This problem is known to those who are skilled in the art as "skew" and is the result of a sheet medium following an oblique course or a deviation from a predetermined straight line along the input path of the printer.

The present invention provides an improved sheet media handling system which affords manual, aligned insertion of a single sheet medium without affecting the input supply of sheet media and without unduly increasing the system's size, complexity or price.

DISCLOSURE OF THE INVENTION

In accordance with the present invention, a sheet media handling system is provided for use in a sheet processor (e.g., a printer). Such system incorporates an input tray for storing one or more sheet media prior to input through the printer's input port with the input tray vertically stacked with the printer's output support structure or tray. The system also has a single sheet medium guide mechanism adjacent the printer's output support structure, where the medium guide mechanism routes a single medium to the input port when the single medium is inserted therein. The single sheet medium guide mechanism includes a skew-abatement substructure and a deflection mechanism. The skew-abatement substructure is designed to facilitate alignment of and routing of a single medium towards the input port by contacting a first edge of the single medium and an opposite second edge of the single medium. Such a deflection mechanism is designed to deflect a single medium toward and into the input port by contacting the upper surface of the single medium while also contacting the lower surface of the single medium. The invented system facilitates easy manual insertion and alignment of a single medium (e.g., an envelope or postcard) into the input port of a printer without affecting the existing supply of sheet media in the input tray.

These and other objects and advantages of the present invention will be more readily understood after a consideration of the drawings and the detailed description of the preferred embodiment which follows.

DETAILED DESCRIPTION OF THE PREFERRED EMBODIMENTS AND BEST MODE FOR CARRYING OUT THE INVENTION

The invented sheet media handling system has two preferred embodiments. A first preferred embodiment of the invented sheet media handling system is shown in FIGS. 1 through 4 and a second preferred embodiment is shown in FIGS. 5 through 9. Any recited preferability of any aspect of the invented system should be read in the context of the specific preferred embodiment being described. Positional terms, such as forward and rearward, are relative a user facing the printer so that the user may insert media into and remove media from the printer.

Figure 1:
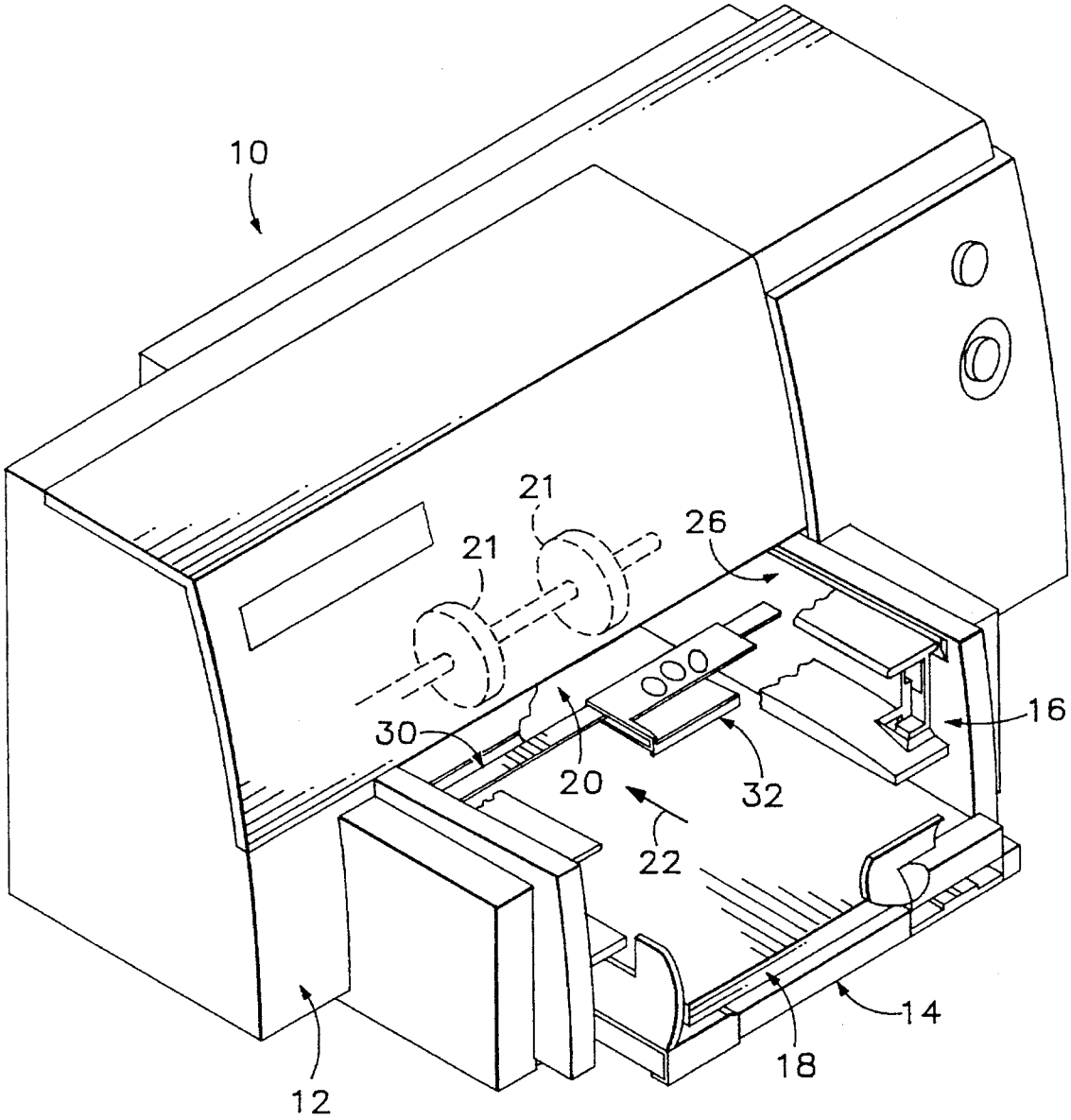
FIG. 1 is an isometric view of a printer incorporating the first preferred embodiment of the invented sheet media handling system.
Figure 3:
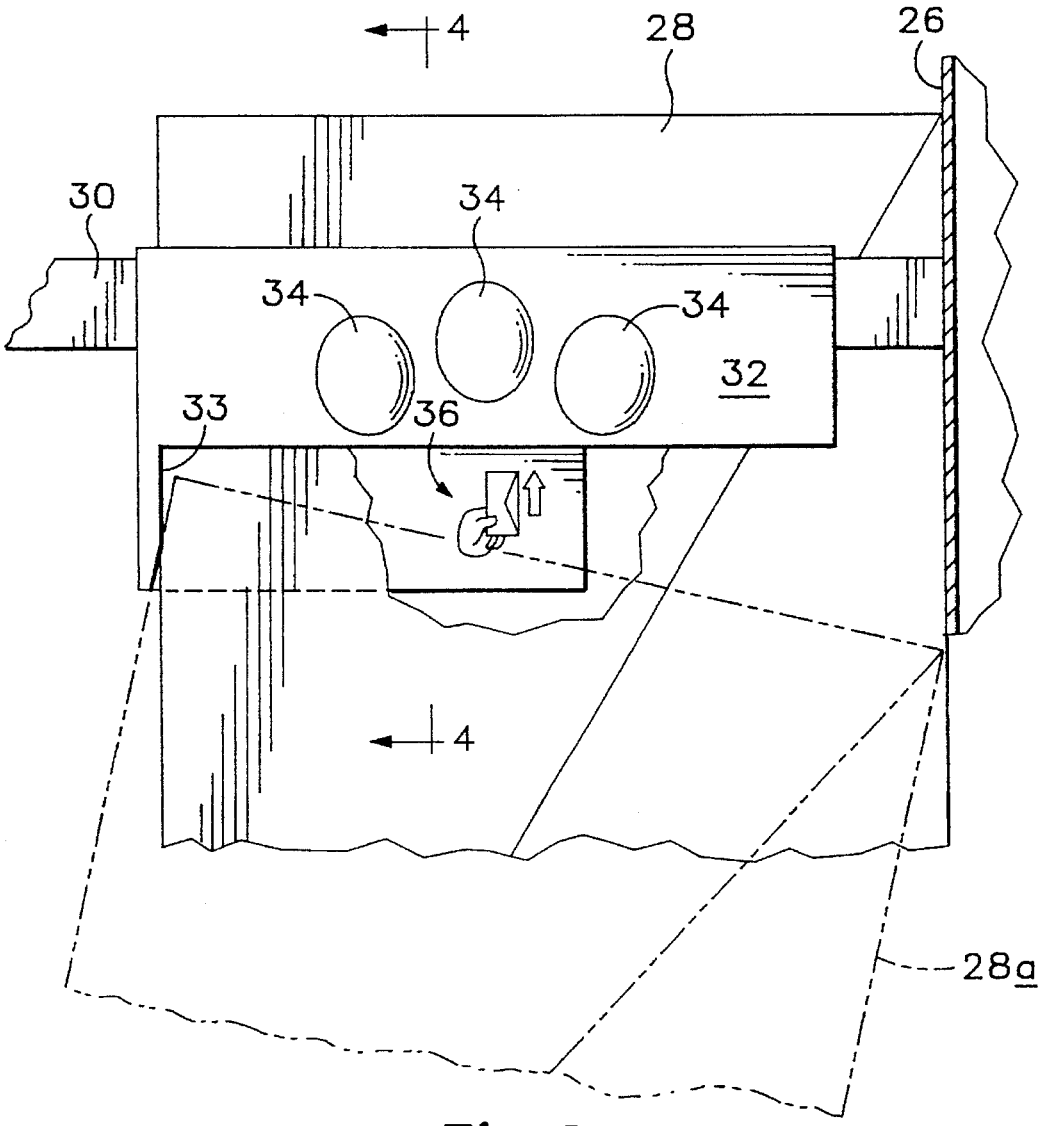
FIG. 3 is a further enlarged, fragmentary top view of the first preferred embodiment of the invented system showing an aligned and a non-aligned envelope.
Figure 4:
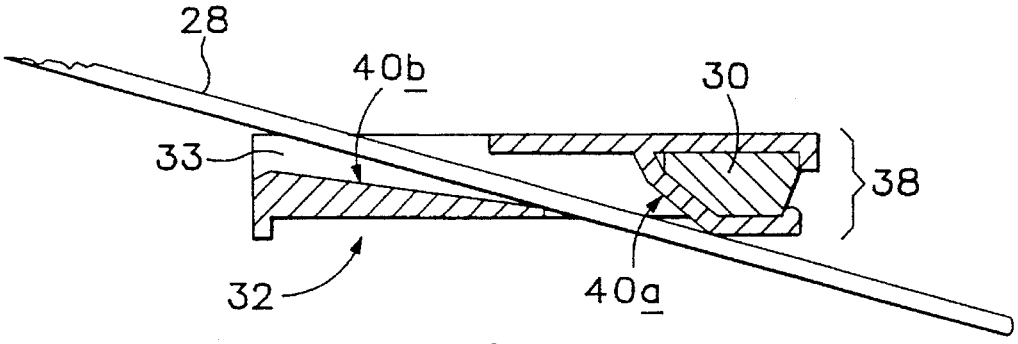
FIG. 4 is a sectional side view of the first preferred embodiment of the invention taken along line 4—4 of FIG. 3 showing a single sheet medium inserted therein.
Figure 5:
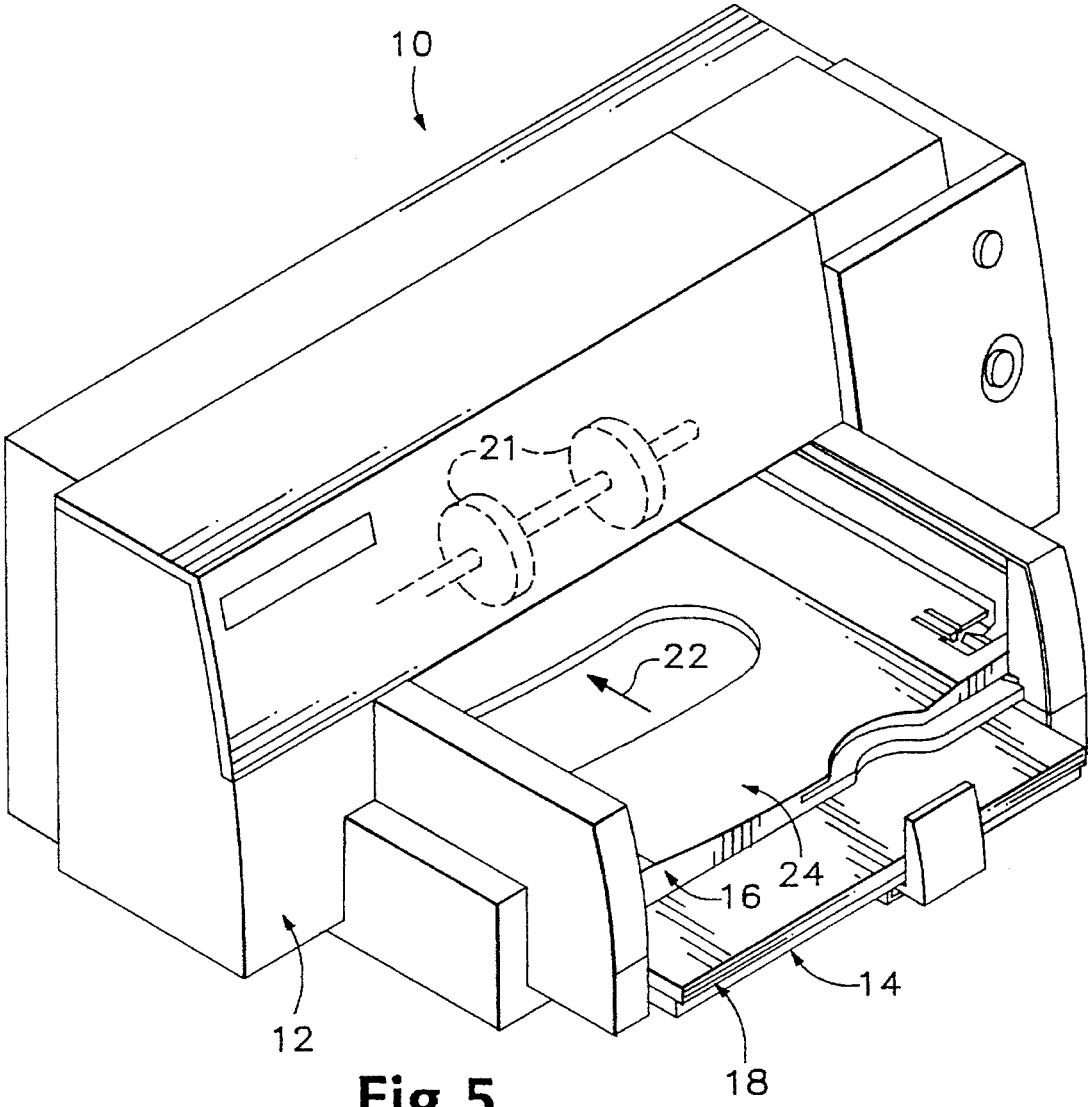
FIG. 5 is an isometric view of a printer incorporating the second preferred embodiment of the sheet media handling system.

The reader's attention is directed to FIGS. 1 through 9 collectively as some of the similar elements and features of the two embodiments are described. FIGS. 1 and 5 show a sheet processor in the form of a somewhat typical ink-jet printer 10. Preferably, the printer includes a chassis 12 which houses an input tray 14 and an existing vertically stacked output support structure or output tray 16. Preferably, the output support structure is above the input tray and both are located at the front of the printer. As indicated, the input tray acts as an input support structure, supporting a sheet media input supply 18 for delivery to the printer through an input port 20 located downstream an input path 22. (Input path 22 is not depicted in FIG. 5.) The printer's drive mechanism pulls paper into the printer's input port along input path 22. Specifically, drive rollers 21 of the drive mechanism pull narrow media from the top of the input stack in the input tray into the print zone of the printer. Drive rollers 21 are nominally spaced to enable the rollers to grab narrow media.

Figure 2:
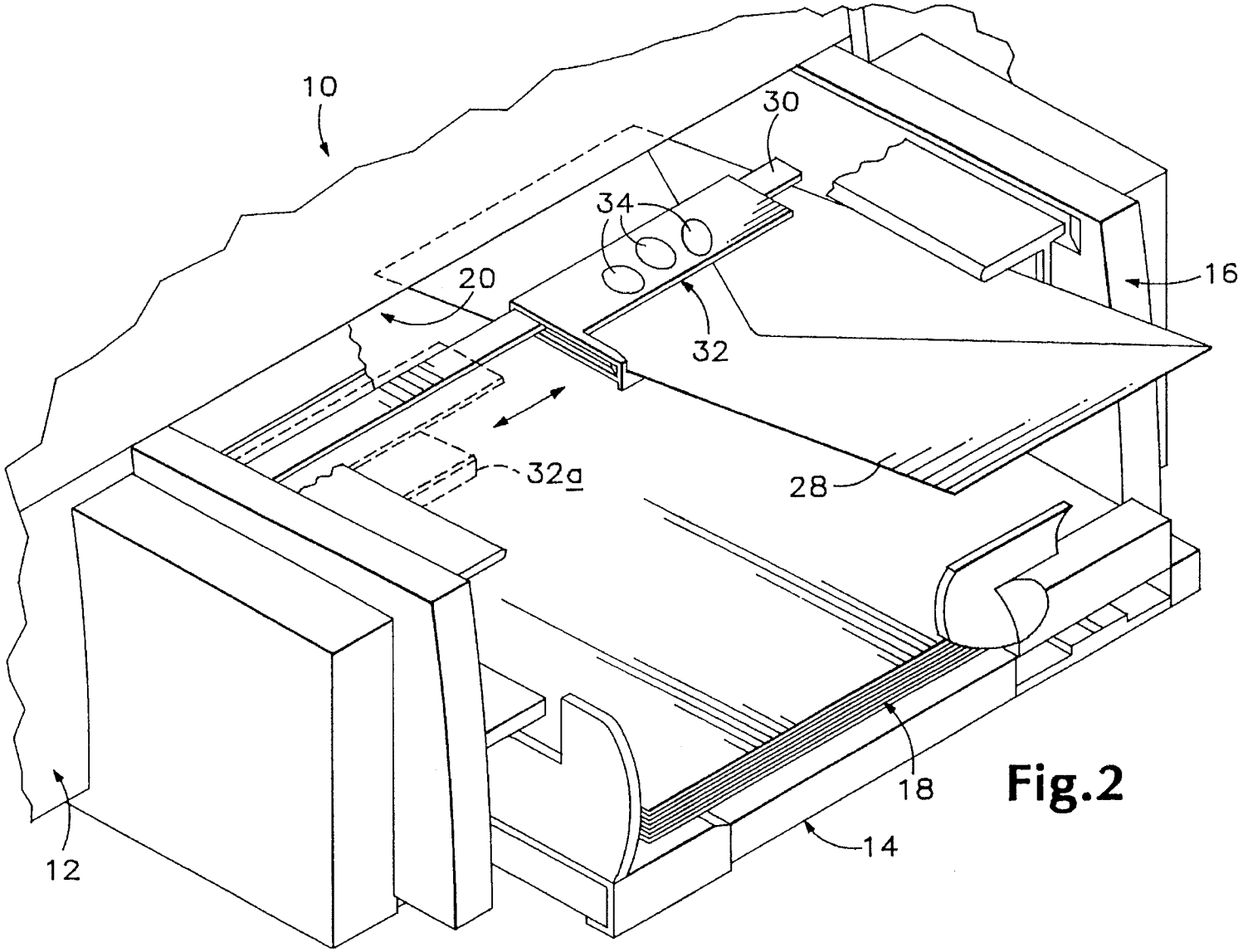
FIG. 2 is a further enlarged, fragmentary, isometric view of the first preferred embodiment of the invented system showing an envelope inserted therein.
Figure 6:
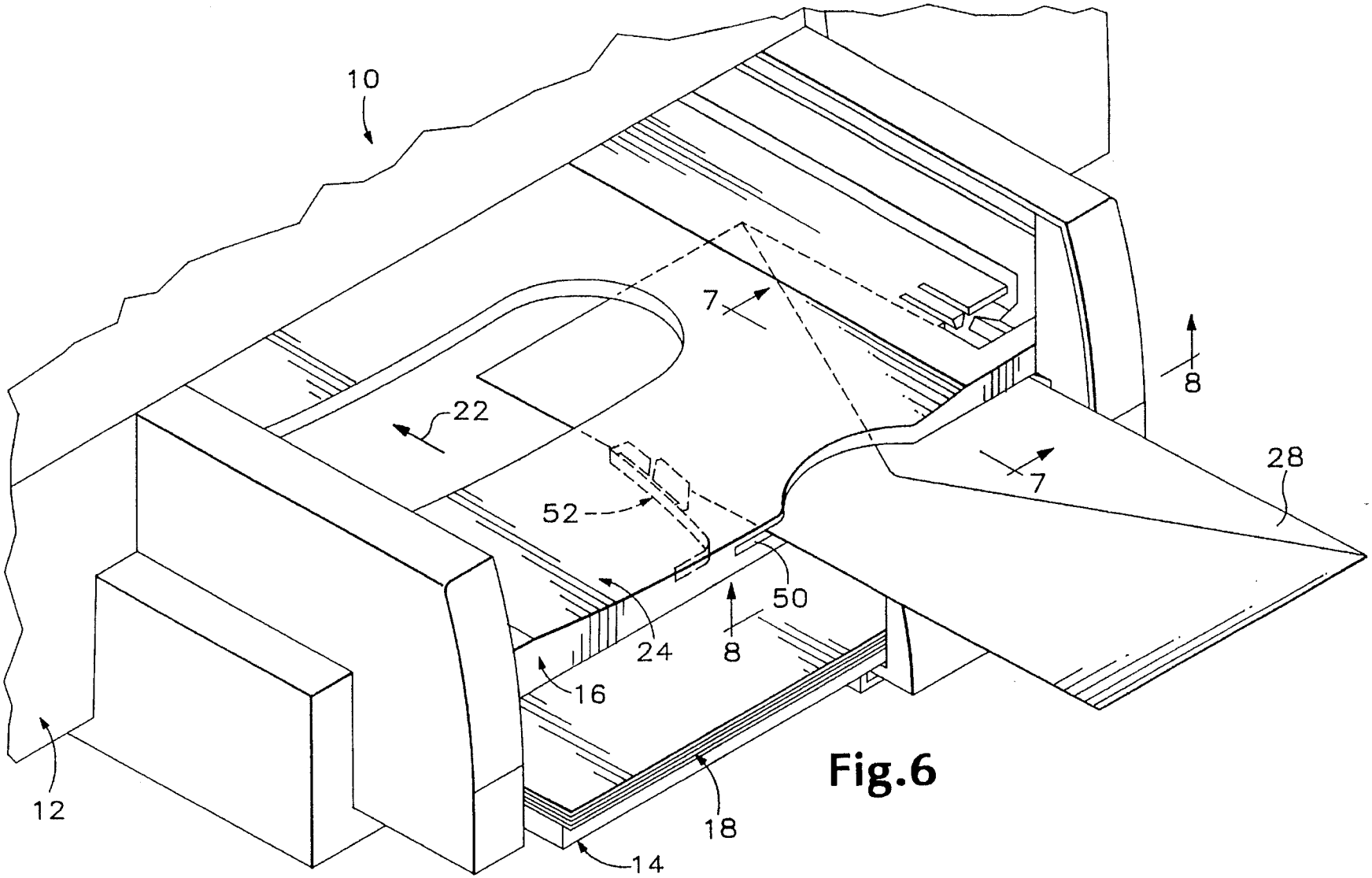
FIG. 6 is an enlarged, fragmentary, isometric view of the second preferred embodiment of the invented system showing an envelope inserted therein.

As seen in FIGS. 5 and 6, existing output support structure 16 of the second embodiment is in the form of an output tray or floor 24 for supporting the media discharged from the printer. As seen in FIG. 1 and 2, output support structure 16 of the first embodiment has only a partial floor. Instead of a full floor, it has structure to contact the discharged media at a few critical areas of the substantially planar bottom surface of the sheet media. This contact provides enough support to hold multiple sheet media.

The invented system facilitates easy manual insertion and alignment of a single medium into input port 20 of a printer without affecting input supply 20 of sheet media in input tray 14. Typically, such a single medium will be a sheet medium that is of smaller dimension (e.g., narrower) than the sheet media held in input tray 14. Examples of narrow sheet media that a user may wish for the invented system to handle include envelopes, postcards, stationary, or other suitable, thin and flat media. FIGS. 2 through 4 and 6 through 9 show a narrow medium, namely, an envelope 28, inserted into the invented system.

Preferably, the input tray and the output support structure are vertically stacked to form a forward media support section defined by two sidewalls, the input and output ports and forward opening for inserting and removing media. The sidewall on the extreme right of the media support section is an orientation sidewall 26. The sidewall is partially shown in FIGS. 1, 2, 5, 6 and 7 and is shown in cross-section in FIGS. 3, 8A and 8B. The sidewall is substantially perpendicular to the input port and is substantially vertical. Therefore, skew can be minimized if the entirety of one edge of a sheet medium maintains continuous contact with sidewall 26 as the sheet medium is pulled into the input port. The orientation sidewall provides a vertical reference plane to help direct and align a sheet medium as it is pulled into the input port. However, additional structure and elements are needed to maintain a sheet medium's alignment during the insertion process. The invented system (including sidewall 26) provides the necessary structure and elements to maintain alignment of a single medium as it is manually inserted into the system and directed toward the input port of the printer.

Preferably, the invented system can be implemented or retrofitted onto existing ink-jet printers either before or after marketing of the printers. Most preferably, the invented system involves a small addition and/or modification of existing structure (e.g., the output support structure) of the printer.

The reader's attention is now directed to the first embodiment and FIGS. 1 through 4 collectively. Preferably, the single sheet medium guide mechanism includes a runner 30, orientation sidewall 26, an alignment sled 32, and deflection guides 40*a*, 40*b*. The first embodiment includes a bar or runner 30 which is connected above and across the input tray and adjacent the output support structure. The runner preferably is attached to the output support structure. The runner is perpendicular input path 22 and its elevation is greater than input port 20. A skew-abatement member-in the form of an alignment sled 32—is attached to runner 30 so that the sled can slide back and forth or reciprocally travel on the runner.

FIG. 2 partially shows a phantom line depicted sled 32*a* to the far left of runner 30. A user can manually slide or translationally adjust sled 32 across runner 30 to a position for receiving and aligning a single medium. The capability of handling media of various size is a key advantage of an adjustable skew-abatement member. The sled has three finger-tip indentions 34 that a user can use to slide the sled back and forth across the runner or it can be thought of as a visual cue indicating to the user that the sled can be adjusted manually. FIG. 2 shows an envelope 28 inserted through sled 32 and along sidewall 26.

In FIG. 3, a fragmentary top view of the first embodiment is shown. FIG. 3 shows the skew-abatement member (in the form of sled 32) and a portion of orientation sidewall 26 with an aligned envelope 28 inserted into the system and a non-aligned envelope 28*a* in phantom lines just before insertion into the system. The two envelopes shown in FIG. 3 illustrate the aligning or skew-abatement function of the invented system. The skew-abatement substructure in the form of the skew-abatement member and orientation sidewall 26 align an inserted single medium to minimize skew and direct the medium to the input port.

The skew-abatement member includes a substantially vertical contact surface 33 as seen in FIGS. 3 and 4. Contact surface 33 faces orientation sidewall 26. When a user wishes to insert an envelope or other single medium, the skew-abatement member is adjusted so that the contact surface contacts a second edge of the envelope and the sidewall contacts a first edge of the envelope. While the envelope is being inserted, contacting two edges of the envelope facilitates routing to the input port and alignment of the envelope. Aligning the narrow medium for drive rollers 21 to grab is a key in minimizing skew. If the narrow medium is aligned when pulled into the printer by the rollers, then skew is minimized because the rollers are designed to pull each medium straight into the printer.

The envelope in FIG. 3 is cut away to reveal an instructional hieroglyphic indicium 36 on the sled. The indicium instructs the user how to use the system. Preferably, the indicium depicts a hand holding an envelope with an adjacent arrow pointing toward the input port and into the system. Of course, any indicium may be within the spirit and scope of the invention if the hieroglyphic indicium instructs the user on how to use the invention.

Figure 7:
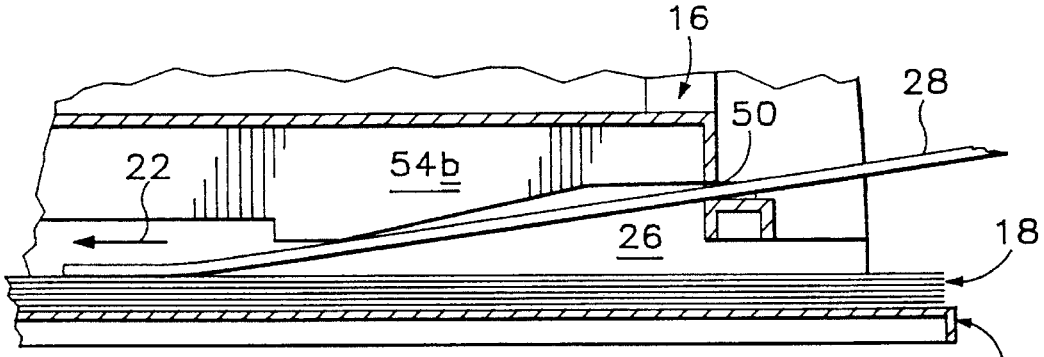
FIG. 7 shows a sectional side view taken along line 7—7 of FIG. 6 showing an envelope deflected downward by the second embodiment of the invention.

FIG. 4 shows a cross-sectional view of the sled taken along lines 4—4 in FIG. 3. The sled includes a runner-engagement bracket 38 for holding onto runner 30 and allowing the sled to slide back and forth. The sled also includes a deflection mechanism having two components: an upper deflection guide 40*a* and a lower deflection guide 40*b*. Upper deflection guide 40*a* facilitates the routing of a single medium toward the input port by contacting a substantially planar upper surface of the single medium. Lower deflection guide 40*b* also facilitates the routing of a single medium toward the input port by contacting a substantially planar lower surface of the single medium. Preferably, the deflection mechanism effectively deflects or redirects an inserted envelope down and into the input port. Unlike the skew-abatement substructure, the deflection mechanism does not align an inserted medium or minimize skew. The deflection mechanism routes or directs the medium toward the input port and, since the deflection mechanism is above the input port, the medium is deflected down. In fact, the deflection mechanism effectively routes the medium toward and into the input port by deflecting the medium onto the top of input supply 18 (see FIG. 7) so that drive rollers 21 can pull the medium into the printer. It will be understood that the same deflection phenomenon that is shown in FIG. 7 occurs in both the first and second embodiments.

The reader's attention is now directed to the second embodiment and FIGS. 5 through 9 collectively. The second embodiment has output support structure 16 in the form of an output tray or floor 24. Preferably, the single sheet medium guide mechanism includes a slot 50, orientation sidewall 26, an automatically biasing arm 52, and upper and lower deflection guides 54, 56. The second embodiment includes a slot 50 that is forwardly disposed and formed in the output tray so that, when a single medium is inserted therein, the medium will be under floor 24. The second embodiment also includes a skew-abatement member in the form of an automatically biasing arm 52 that is mounted beneath floor 24 of the output tray.

Figure 8A:
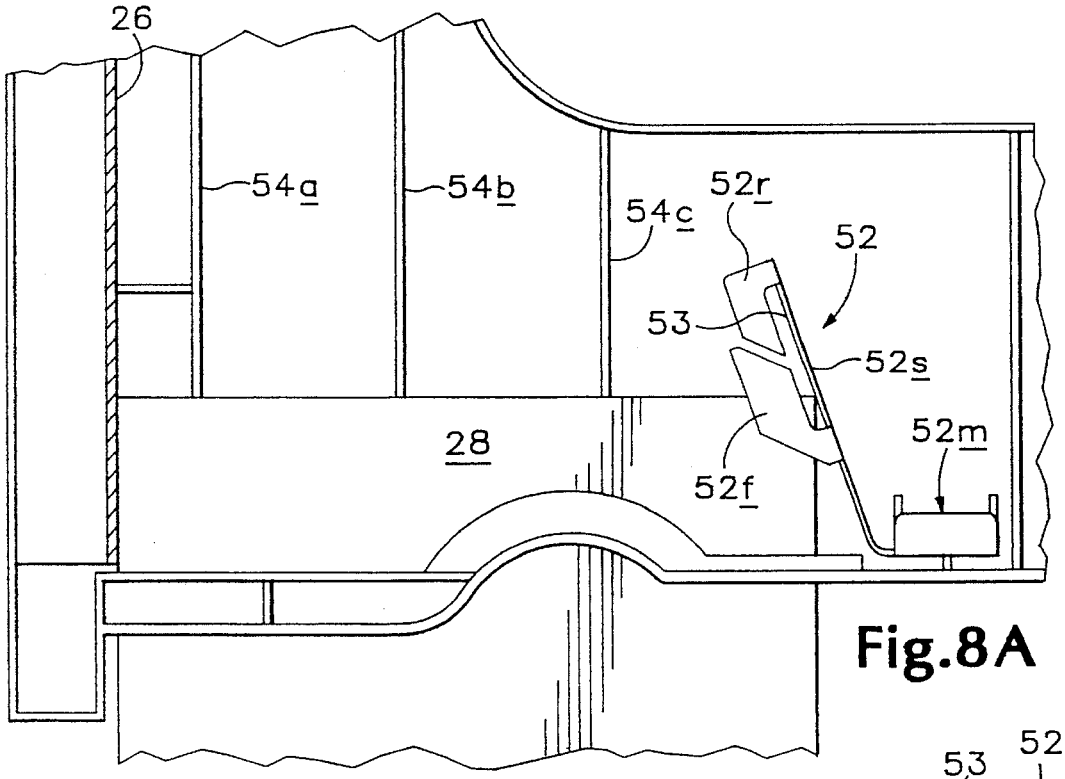
FIG. 8A and 8B are enlarged, fragmentary bottom views taken along line 8—8 of FIG. 6 showing the operation of the biasing arm of the second embodiment of the invention.
Figure 8B:
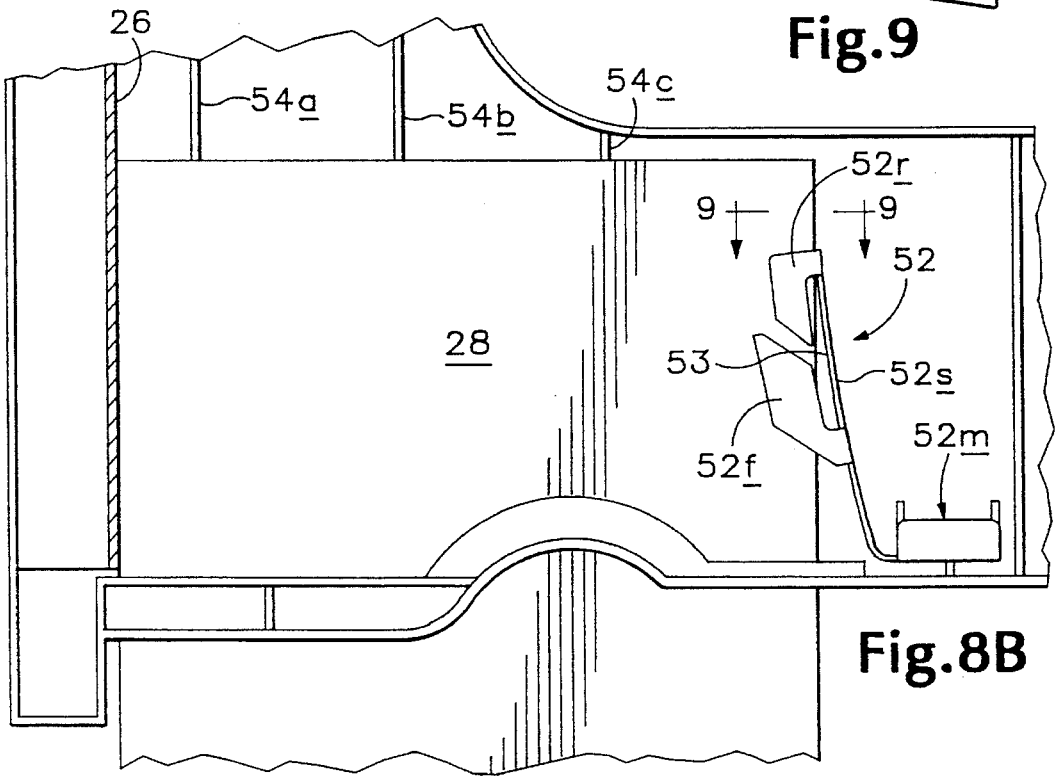

As seen in FIGS. 6, 8A and 8B, the biasing arm is configured to urge a single medium toward sidewall 26 (not shown in FIG. 6). The spring or biasing property of arm 52 allows the arm automatically to adjust to the particular size of the sheet medium that is inserted and to align that medium. Preferably, arm 52 is formed from metal or other sufficiently spring-like material. Also, the arm has sufficient spring force to handle a wide range of single media sizes or masses. Preferably, the spring force is enough to align a media within the range of twenty to eighty grams.

The arm has a mounting structure 52*m* for attaching the arm to the underside of floor 24 of the output tray. A substantially vertical and flat arm segment 52*s* extends from the mounting structure at an oblique angle (relative to input path 22). FIG. 8A shows arm 52 in an unbiased or unbent condition and also shows an envelope inserted through the slot just as it contacts a substantially vertical contact surface 53 of the arm. FIG. 8B shows an envelope further inserted through the slot causing arm 52 to bend and facilitate the alignment of the envelope by urging it against orientation sidewall 26. The skew-abatement substructure in the form of the skew-abatement member (arm 52) and orientation sidewall 26 align an inserted single medium to minimize skew and to direct a properly aligned medium to the input port.

Figure 9:
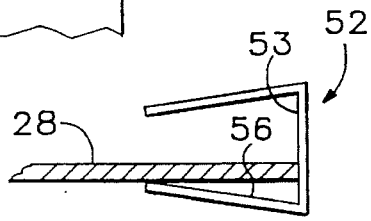
FIG. 9 is a further enlarged sectional view of the biasing arm and an envelope taken along line 9—9 in FIG. 8B.

Arm 50 preferably also has four channel blades connected to the arm segment. Two blades on each side of arm segment 52*s* face two blades on the other side of the segment to form a C-like or C-shaped channel, as seen in FIG. 9. FIGS. 8A and 8B show one of the pair of forward blades 52*f* and one of the pair of rearward blades 52*r*.

FIG. 9 shows a view of the channel formed by the blades taken along lines 9—9 in FIG. 8B. FIG. 9 also shows a portion of single medium 28. As seen in FIG. 9, the blades form an open channel with a slightly narrowing and angled top and bottom of the C-shape. The channel is designed to better capture the envelope as it is being inserted as shown in FIGS. 8A, 8B and 9.

FIGS. 7 through 9 illustrate the deflection mechanism in the second preferred embodiment. The deflection mechanism includes one or more upper deflection guides 54 and a lower deflection guide 56. In the second preferred embodiment, the deflection mechanism includes at least three upper deflection guides 54*a*, 54*b*, 54*c* and its structure and function is best illustrated in FIGS. 7 and 8A. The upper deflection guides 54 facilitate the routing of a single medium toward the input port by contacting the substantially planar upper surface of the single medium. Thus, the upper deflection guide effectively deflects or redirects an inserted envelope down toward the input port along input path 22. Lower deflection guide 56 is in the form of the lower one of the pair of rearward blades 52*r* as seen in FIG. 9. The lower deflection guide also facilitates the routing of a single medium toward the input port by contacting a substantially planar lower surface of the single medium. The lower deflection guide helps properly deflect or redirect an inserted envelope toward the input port in cooperation with the upper deflection guides. FIG. 7 best illustrates the deflection of the envelope onto the top of input supply 18 so that drive rollers 21 can pull the envelope into the printer.

The invented system as illustrated by the two preferred embodiments allows the user to insert a single medium without disturbing the existing input supply, while ensuring the proper alignment of the single medium. The invented system performs a dual action on the inserted media to properly align and route the medium. The dual action is provided by 1) the skew-abatement substructure that aligns and routes the medium to the input port and 2) the deflection mechanism that deflects or routes the medium preferably downward to the input port.

INDUSTRIAL APPLICABILITY

Although particularly well-suited for use for an ink-jet printer, the above-described sheet media handling system is useful in virtually any sheet processor wherein various-sized sheets are to be printed. The system is especially effective in sheet processors wherein a user desires to print on media of a size that differs from the size of the media in the input tray. The system avoids the hassle and time required to place a different-sized medium on the input supply or replaces the input supply while ensuring the proper alignment of media inserted therein.

While the present invention has been shown and described with reference to the foregoing operational principles and preferred embodiment, it will be apparent that to those skilled in the art that various changes in form and detail may be made without departing from the spirit and scope of the invention as defined by the appended claims.

We claim:

1. A sheet media handling system for use in a printer including an input path that sheet media follows when introduced into the printer and an input port located downstream the input path, wherein the input port receives sheet media introduced into the printer, the system comprising:

an input tray for storing one or more sheet media prior to input into the input port, wherein the input tray is attached to the printer; and a single sheet medium guide mechanism attached to the printer, wherein the medium guide mechanism including a substantially vertical orientation sidewall fixed relative to the input port for facilitating routing of the single medium toward the input port and aligning the single medium to minimize skew by contacting a first edge of the single medium and a movable skew-abatement member with a substantially vertical contact surface facing the sidewall for contacting a second edge of the single medium, wherein the skew-abatement member acts with the sidewall for further facilitating routing of the single medium toward the input port and aligning of the single medium routes the single medium toward the input port and aligns the single medium with the input path when the single medium is inserted into the guide mechanism.

2. The handling system of claim 1, wherein the skew-abatement member is manually, translationally adjustable relative to the sidewall.

3. The handling system of claim 1, wherein the skew-abatement member is an automatically biasing arm configured to urge the single medium toward the sidewall.

4. The handling system of claim 1, wherein the medium guide mechanism further includes a deflection mechanism to deflect a single medium toward the input port.

5. The handling system of claim 4, wherein the deflection mechanism includes:

an upper deflection guide for facilitating routing of the single medium toward the input port by contacting a substantially planar upper surface of the single medium; and a lower deflection guide that acts with the upper deflection guide for further facilitating routing of the single medium toward the input port by contacting a substantially planar lower surface of the single medium.

6. The handling system of claim 1, wherein the handling system further includes an output support structure above the input tray and the input port.

7. The handling system of claim 6, wherein the medium guide mechanism is attached to the output support structure.

8. The handling system of claim 7, wherein the output support structure is an output tray.

9. The handling system of claim 8, wherein the medium guide mechanism includes a slot defined by the output tray, wherein the slot is for insertion of a single medium therein.

10. The handling system of claim 1, wherein the sheet media handling system includes an instructional hieroglyphic indicium that indicates the use and operation of the sheet media handling system.

11. The handling system of claim 1, wherein the handling system further includes an output tray.

12. The handling system of claim 11, wherein the medium guide mechanism includes a slot defined by the output tray, wherein the slot is for insertion of a single medium therein.

13. In a sheet media handling system of a printer including an input path that sheet media follows when introduced into the printer, an input port located downstream of the input path, wherein the input port receives sheet media introduced into the primer, an output support structure for holding discharged sheet media, and wherein a single medium includes a substantially planar upper surface and an opposite, substantially planar lower surface and a first edge and an opposite, second edge, the improvement comprising:

a single sheet medium guide mechanism connected to the output support structure, wherein the medium guide mechanism is for routing a single medium to the input port and aligning the single medium to minimize skew when the single medium is inserted therein and the medium guide mechanism includes:

a skew-abatement substructure for facilitating routing of the single medium toward the input port and aligning the single medium to minimize skew by contacting the first edge and the second edge of the single medium, the skew-abatement substructure including a substantially vertical orientation sidewall for facilitating aligning of the single medium and routing of the single medium toward the input port by contacting the first edge of the single medium and a skew-abatement member with a substantially vertical contact surface facing the sidewall to contact the second edge of the single medium, the skew-abatement member including an automatically biasing arm which acts with the sidewall for further facilitating aligning and routing of the single medium toward the input port, the biasing arm being configured to urge the single medium toward the sidewall; and a deflection mechanism for deflecting a single medium toward the input port by contacting the upper surface and the lower surface of the single medium.

14. The improvement of claim 13, wherein the biasing arm has a C-shaped channel facing the orientation sidewall for routing the single medium toward the input port while the second edge of the single medium contacts the contact surface.

15. The improvement of claim 13, wherein the deflection mechanism includes:

an upper deflection guide for facilitating routing of the single medium toward the input port by contacting the substantially planar upper surface of the single medium; and a lower deflection guide that acts with the upper deflection guide for further facilitating routing of the single medium toward the input port by contacting the substantially planar lower surface of the single medium.

16. The improvement of claim 13, wherein the output support structure is an output tray and the medium guide mechanism includes a slot defined by the output tray, wherein the slot is for insertion of a single medium therein.

* * * * *